US012263371B2

(12) United States Patent
Larsen

(10) Patent No.: US 12,263,371 B2
(45) Date of Patent: Apr. 1, 2025

(54) DEVICES, SYSTEMS, AND METHODS FOR ROTATING A TREAD BELT IN TWO DIRECTIONS

(71) Applicant: iFIT Inc., Logan, UT (US)

(72) Inventor: Trenton Von Larsen, Hyrum, UT (US)

(73) Assignee: iFIT Inc., Logan, UT (US)

( * ) Notice: Subject to any disclaimer, the term of this patent is extended or adjusted under 35 U.S.C. 154(b) by 305 days.

(21) Appl. No.: 17/729,853

(22) Filed: Apr. 26, 2022

(65) Prior Publication Data

US 2022/0339493 A1 Oct. 27, 2022

Related U.S. Application Data

(60) Provisional application No. 63/180,461, filed on Apr. 27, 2021.

(51) Int. Cl.
*A63B 22/02* (2006.01)
*A63B 24/00* (2006.01)

(52) U.S. Cl.
CPC ..... *A63B 22/0242* (2013.01); *A63B 24/0087* (2013.01); *A63B 2022/0278* (2013.01)

(58) Field of Classification Search
CPC ..... A63B 22/0242; A63B 24/0087; A63B 2022/0278; A63B 2071/0081; A63B 2071/0625; A63B 2071/068; A63B 2071/0694; A63B 2230/06
See application file for complete search history.

(56) References Cited

U.S. PATENT DOCUMENTS

| | | | | |
|---|---|---|---|---|
| 3,123,646 | A | 3/1964 | Easton | |
| 3,579,339 | A | 5/1971 | Chang et al. | |
| 4,023,795 | A | 5/1977 | Pauls | |
| 4,300,760 | A | 11/1981 | Bobroff | |
| D286,311 | S | 10/1986 | Martinell et al. | |
| 4,681,318 | A | 7/1987 | Lay | |
| 4,684,126 | A | 8/1987 | Dalebout et al. | |
| 4,728,102 | A | 3/1988 | Pauls | |
| 4,750,736 | A | 6/1988 | Watterson | |
| 4,796,881 | A | 1/1989 | Watterson | |
| 4,813,667 | A | 3/1989 | Watterson | |
| 4,830,371 | A | 5/1989 | Lay | |
| 4,844,451 | A | 7/1989 | Bersonnet et al. | |
| 4,850,585 | A | 7/1989 | Dalebout et al. | |
| D304,849 | S | 11/1989 | Watterson | |
| 4,880,225 | A | 11/1989 | Lucas et al. | |
| 4,883,272 | A | 11/1989 | Lay | |
| 4,886,266 | A * | 12/1989 | Trulaske ..... | A63B 22/0023 198/840 |

(Continued)

FOREIGN PATENT DOCUMENTS

KR 2003284840000 9/2003

OTHER PUBLICATIONS

U.S. Appl. No. 17/066,485, filed Oct. 9, 2020, Weston et al.

(Continued)

*Primary Examiner* — Joshua Lee
(74) *Attorney, Agent, or Firm* — Holland & Hart LLP

(57) ABSTRACT

A treadmill includes a tread belt that is rotatable in a forward direction and a backward direction. Before changing rotation directions on the tread belt, the treadmill implements a safety action. The safety action includes an alert and input in response to the alert to improve the safety of the user.

17 Claims, 8 Drawing Sheets

(56) References Cited

U.S. PATENT DOCUMENTS

D306,468 S 3/1990 Watterson
D306,891 S 3/1990 Watterson
4,913,396 A 4/1990 Dalebout et al.
D307,614 S 5/1990 Bingham et al.
D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.

(56) References Cited

U.S. PATENT DOCUMENTS 5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
6,334,839 B1 * 1/2002 Lim ..... A63B 22/0242 482/54
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,676,569 B1 6/2004 Radow
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,575,537 B2 8/2009 Ellis
7,601,105 B1 10/2009 Gipson et al.
7,604,573 B2 10/2009 Dalebout et al.
D604,373 S 11/2009 Dalebout et al.
7,618,346 B2 * 11/2009 Crawford ..... A63B 22/0015 482/8
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout et al.
7,775,940 B2 8/2010 Dalebout et al.
7,780,573 B1 * 8/2010 Carmein ..... A63B 71/0622 482/4
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,967,730 B2 * 6/2011 Crawford ..... A63B 24/0087 482/52
7,980,856 B2 * 7/2011 Grabiner ..... A63B 22/0292 434/258
7,980,996 B2 7/2011 Hickman
7,981,000 B2 7/2011 Watterson et al.
7,985,164 B2 7/2011 Ashby

(56) References Cited

U.S. PATENT DOCUMENTS 8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,298,123 B2 10/2012 Hickman
8,298,125 B2 10/2012 Colledge et al.
D671,177 S 11/2012 Sip
D671,178 S 11/2012 Sip
D673,626 S 1/2013 Olson et al.
8,690,735 B2 4/2014 Watterson et al.
D707,763 S 6/2014 Cutler
8,740,753 B2 6/2014 Olson et al.
8,758,201 B2 6/2014 Ashby et al.
8,771,153 B2 7/2014 Dalebout et al.
8,784,270 B2 7/2014 Ashby et al.
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,911,330 B2 12/2014 Watterson et al.
8,920,288 B2 12/2014 Dalebout et al.
8,968,161 B2 * 3/2015 Shapiro ..... A63B 26/003 482/4
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,072,930 B2 7/2015 Ashby et al.
9,119,983 B2 9/2015 Rhea
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 10/2015 Watterson et al.
9,186,535 B2 11/2015 Ercanbrack
9,186,549 B2 11/2015 Watterson et al.
9,254,409 B2 2/2016 Dalebout et al.
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson et al.
9,352,186 B2 5/2016 Watterson
9,375,605 B2 6/2016 Tyger et al.
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson et al.
9,630,060 B2 * 4/2017 Volkerink ..... A63B 71/0619
9,636,567 B2 5/2017 Brammer et al.
9,675,839 B2 6/2017 Dalebout et al.
9,682,307 B2 6/2017 Dalebout
9,694,234 B2 7/2017 Dalebout et al.
9,694,242 B2 7/2017 Ashby et al.
9,737,755 B2 8/2017 Dalebout
9,757,605 B2 9/2017 Olson et al.
9,764,186 B2 9/2017 Dalebout et al.
9,767,785 B2 9/2017 Ashby et al.
9,795,822 B2 10/2017 Smith et al.
9,808,672 B2 11/2017 Dalebout
9,844,699 B2 * 12/2017 Volkerink ..... H04W 4/70
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen et al.
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack et al.
D827,733 S 9/2018 Hochstrasser
10,065,064 B2 9/2018 Smith et al.
10,071,285 B2 9/2018 Smith et al.
10,080,951 B2 * 9/2018 Buvid ..... G06T 19/00
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson et al.
10,207,143 B2 2/2019 Dalebout et al.
10,207,145 B2 2/2019 Tyger et al.
10,207,146 B2 * 2/2019 Liao ..... A63B 24/0087
10,207,147 B2 2/2019 Ercanbrack et al.
10,207,148 B2 2/2019 Powell et al.
10,212,994 B2 2/2019 Watterson et al.
10,220,259 B2 3/2019 Brammer
10,226,396 B2 3/2019 Ashby
10,226,664 B2 3/2019 Dalebout et al.
10,238,911 B2 * 3/2019 Bayerlein ..... A63B 23/04
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout

(56) References Cited

U.S. PATENT DOCUMENTS 10,433,612 B2 10/2019 Ashby et al.
10,441,840 B2 10/2019 Dalebout
10,441,844 B2 10/2019 Powell
10,449,416 B2 10/2019 Dalebout et al.
10,471,299 B2 11/2019 Powell
D868,909 S 12/2019 Cutler et al.
10,492,519 B2 12/2019 Capell et al.
10,493,349 B2 12/2019 Watterson
10,500,473 B2 12/2019 Watterson
10,537,764 B2 1/2020 Smith et al.
10,543,395 B2 1/2020 Powell et al.
10,561,877 B2 2/2020 Workman
10,561,893 B2 2/2020 Chatterton et al.
10,561,894 B2 2/2020 Dalebout et al.
10,569,121 B2 2/2020 Watterson
10,569,123 B2 2/2020 Hochstrasser et al.
10,625,114 B2 4/2020 Ercanbrack
10,625,137 B2 4/2020 Dalebout et al.
10,661,114 B2 5/2020 Watterson et al.
10,668,320 B2 6/2020 Watterson
10,671,705 B2 6/2020 Capell et al.
10,688,346 B2 6/2020 Brammer
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson et al.
10,786,706 B2 9/2020 Smith
10,864,407 B2 12/2020 Watterson et al.
10,905,914 B2 * 2/2021 Bayerlein ..... A63B 71/0622
10,918,905 B2 2/2021 Powell et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,967,214 B1 4/2021 Olson et al.
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,187,285 B2 11/2021 Wrobel
11,298,577 B2 4/2022 Watterson
11,304,627 B2 * 4/2022 Sato ..... A61B 5/1116
11,326,673 B2 5/2022 Buchanan
11,338,169 B2 5/2022 Dalebout et al.
11,338,175 B2 5/2022 Watterson et al.
11,420,092 B2 * 8/2022 Bayerlein ..... A63B 23/04
11,426,633 B2 8/2022 Watterson et al.
11,451,108 B2 9/2022 Tinney
11,452,903 B2 9/2022 Watterson
11,511,152 B2 11/2022 Powell et al.
11,534,651 B2 12/2022 Ercanbrack et al.
11,534,654 B2 12/2022 Silcock et al.
11,534,655 B2 12/2022 Dalebout et al.
11,565,148 B2 1/2023 Dalebout et al.
11,596,830 B2 3/2023 Dalebout et al.
11,642,564 B2 5/2023 Watterson
11,673,036 B2 6/2023 Dalebout et al.
11,680,611 B2 6/2023 Wrobel
11,700,905 B2 7/2023 Ashby et al.
11,708,874 B2 7/2023 Wrobel
11,724,157 B2 * 8/2023 Shintani ..... A63B 26/003
482/54
2005/0148432 A1 * 7/2005 Carmein ..... A63B 22/0235
482/8
2006/0247104 A1 * 11/2006 Grabiner ..... A63B 69/0064
482/54
2008/0020907 A1 * 1/2008 Lin ..... A63B 22/0235
482/54
2008/0051256 A1 2/2008 Ashby et al.
2015/0238819 A1 * 8/2015 Volkerink ..... G08C 17/02
482/4
2015/0251055 A1 9/2015 Ashby
2017/0124912 A1 5/2017 Ashby et al.
2017/0193578 A1 7/2017 Watterson
2017/0203157 A1 * 7/2017 Volkerink ..... A63B 22/0242
2017/0266489 A1 9/2017 Douglass et al.
2017/0270820 A1 9/2017 Ashby et al.
2018/0050256 A1 * 2/2018 Buvid ..... G06T 13/40
2018/0085630 A1 3/2018 Capell et al.
2018/0099116 A1 4/2018 Ashby
2018/0099180 A1 4/2018 Wilkinson
2018/0111034 A1 4/2018 Watterson
2018/0250552 A1 * 9/2018 Liao ..... A63B 71/0054
2019/0223612 A1 7/2019 Watterson et al.
2019/0269971 A1 9/2019 Capell et al.
2020/0009417 A1 1/2020 Dalebout
2020/0234496 A1 * 7/2020 de Belle ..... G06F 3/011
2020/0391069 A1 8/2020 Olson et al.
2020/0368575 A1 11/2020 Hays et al.
2021/0001177 A1 1/2021 Smith
2021/0046353 A1 2/2021 Dalebout et al.
2021/0106899 A1 4/2021 Willardson et al.
2021/0110910 A1 4/2021 Ostler et al.
2021/0146221 A1 5/2021 Dalebout et al.
2021/0213331 A1 7/2021 Watterson
2021/0245010 A1 * 8/2021 Shintani ..... A63B 22/02
2021/0268336 A1 9/2021 Watterson et al.
2021/0291013 A1 9/2021 Nascimento
2021/0299518 A1 9/2021 Brammer et al.
2021/0299542 A1 9/2021 Brammer et al.
2021/0339079 A1 11/2021 Dalebout et al.
2021/0346752 A1 * 11/2021 Holmes ..... A63B 24/0075
2022/0062685 A1 3/2022 Ashby et al.
2022/0104992 A1 4/2022 Ashby
2022/0212052 A1 7/2022 Ercanbrack et al.
2022/0241649 A1 8/2022 Ashby
2022/0241665 A1 8/2022 Dalebout et al.
2022/0241668 A1 8/2022 Willardson et al.
2022/0249912 A1 8/2022 Watterson et al.
2022/0257994 A1 8/2022 Smith
2022/0258007 A1 8/2022 Watterson et al.
2022/0258008 A1 8/2022 Watterson et al.
2022/0266085 A1 8/2022 Dalebout et al.
2022/0280857 A1 9/2022 Watterson
2022/0309042 A1 9/2022 Archer
2022/0314078 A1 10/2022 Watterson et al.
2022/0323827 A1 10/2022 Watterson et al.
2022/0339493 A1 10/2022 Larsen
2022/0339520 A1 10/2022 Toth
2022/0342969 A1 10/2022 Watterson et al.
2022/0347516 A1 11/2022 Taylor
2022/0347548 A1 11/2022 Watterson
2022/0362613 A1 11/2022 Watterson et al.
2022/0362624 A1 11/2022 Dalebout
2022/0395729 A1 12/2022 Toth
2023/0039903 A1 2/2023 Brammer et al.
2023/0054845 A1 2/2023 Smith
2023/0122235 A1 4/2023 Ashby et al.
2023/0128721 A1 4/2023 Plummer
2023/0158358 A1 5/2023 Ercanbrack et al.
2023/0181993 A1 6/2023 Taylor et al.
2023/0191189 A1 6/2023 Taylor et al.
2023/0191197 A1 6/2023 Ashby
2023/0218975 A1 7/2023 Toles et al.
2023/0226401 A1 7/2023 Watterson

OTHER PUBLICATIONS

U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/103,221, filed Jan. 30, 2023, Dalebout et al.
U.S. Appl. No. 18/114,758, filed Feb. 27, 2023, Cutler et al.
U.S. Appl. No. 18/117,263, filed Mar. 3, 2023, Smith et al.
U.S. Appl. No. 18/123,026, filed Mar. 17, 2023, Silcock et al.
U.S. Appl. No. 18/132,277, filed Apr. 7, 2023, Vasquez et al.

(56) References Cited

OTHER PUBLICATIONS

U.S. Appl. No. 18/136,535, filed Apr. 19, 2023, Ashby et al.
U.S. Appl. No. 18/141,872, filed May 1, 2023, Ashby et al.
U.S. Appl. No. 18/205,299, filed Jun. 2, 2023, Wrobel.
U.S. Appl. No. 18/207,512, filed Jun. 8, 2023, Chuang.
U.S. Appl. No. 18/210,505, filed Jun. 15, 2023, Nielsen et al.
U.S. Appl. No. 29/702,127, filed Sep. 16, 2019, Cutler et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al.
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.

* cited by examiner

DEVICES, SYSTEMS, AND METHODS FOR ROTATING A TREAD BELT IN TWO DIRECTIONS

CROSS-REFERENCE TO RELATED APPLICATIONS

This application claims priority to and the benefit of U.S. Provisional Patent Application No. 63/180,461, filed on Apr. 27, 2021, which is hereby incorporated by reference in its entirety.

BACKGROUND

Background and Relevant Art

While running on a treadmill, a tread belt typically rotates about a tread deck from a front end to a back end. When a user steps on the tread belt on top of the deck, the tread belt may pull his foot from the front end to the back end. As the user's foot is dragged toward the back end by the tread belt, the user may extend his other foot and place it on the tread belt closer to the front end. The user may repeat this process indefinitely, so that the user may simulate a walk, run, or sprint. In this manner, the user may walk or run in a "forward" direction. A forward direction may be motion, either simulated (such as on a treadmill), or actual (such as on the ground) of the user in the direction the user is facing. When a tread belt rotates from the front end to the back end over the top (e.g., the working surface) of the tread deck, the tread belt may be rotating in the forward direction.

The front end of the tread deck typically includes a console, which may include a display, input, speakers, fan, and other elements. While using the treadmill, the user may desire to face the console to interact with its various elements. Typical treadmills are designed so that the user may face the console while walking or running in the forward direction (e.g., when the tread belt is rotating from the front end to the back end over a working surface of the deck).

BRIEF SUMMARY

In some embodiments, a treadmill includes a deck. A tread belt extends around the deck from a front end to a rear end of the deck. A first motor causes the tread belt to rotate from the front end to the rear end and a second motor causes the tread belt to rotate from the rear end to the front end.

In other embodiments, a method for operating a treadmill includes rotating a tread belt around a deck of the treadmill in a first direction. An input is received to rotate the tread belt in a second direction. Before rotating the tread belt in the second direction, a safety action is implemented. Then the tread belt is rotated in the second direction.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which.

DETAILED DESCRIPTION

This disclosure generally relates to devices, systems, and methods for treadmills with a tread deck that rotates in the forwards and backwards direction. Some exercises may involve a user walking or running in a "backward" direction. A backward direction may be motion, either simulated (such as on a treadmill), or actual (such as on the ground) of the user in the direction opposite he or she is facing. Conventionally, the tread deck of a treadmill may only rotate in the forward direction (e.g., from the front end to the back end over the top of the tread deck). To walk or run backwards on the treadmill, the user may turn around and face away from the console. However, when facing away from the console, the user may not be able to see the display and/or interact with the input elements. This may introduce safety concerns, because the user may not be able to easily activate an emergency stop, change the tread belt speed, view exercise information on the display, other safety concerns, and combinations thereof.

In accordance with embodiments of the present disclosure, a treadmill may be configured to rotate the tread belt in the forward direction and in the backward direction. Rotating the tread belt in the backward direction may include rotating the tread belt from the rear end to the front end over the top of the deck. By rotating the tread belt in the backward direction, the user may face forward on the treadmill (e.g., the console). This may allow the user full access of the features of the console. In this manner, the safety of the user while walking or running backwards may be increased because the user may be able to access the emergency stop, the speed controls, exercise information on the console, and so forth.

Figure 1:
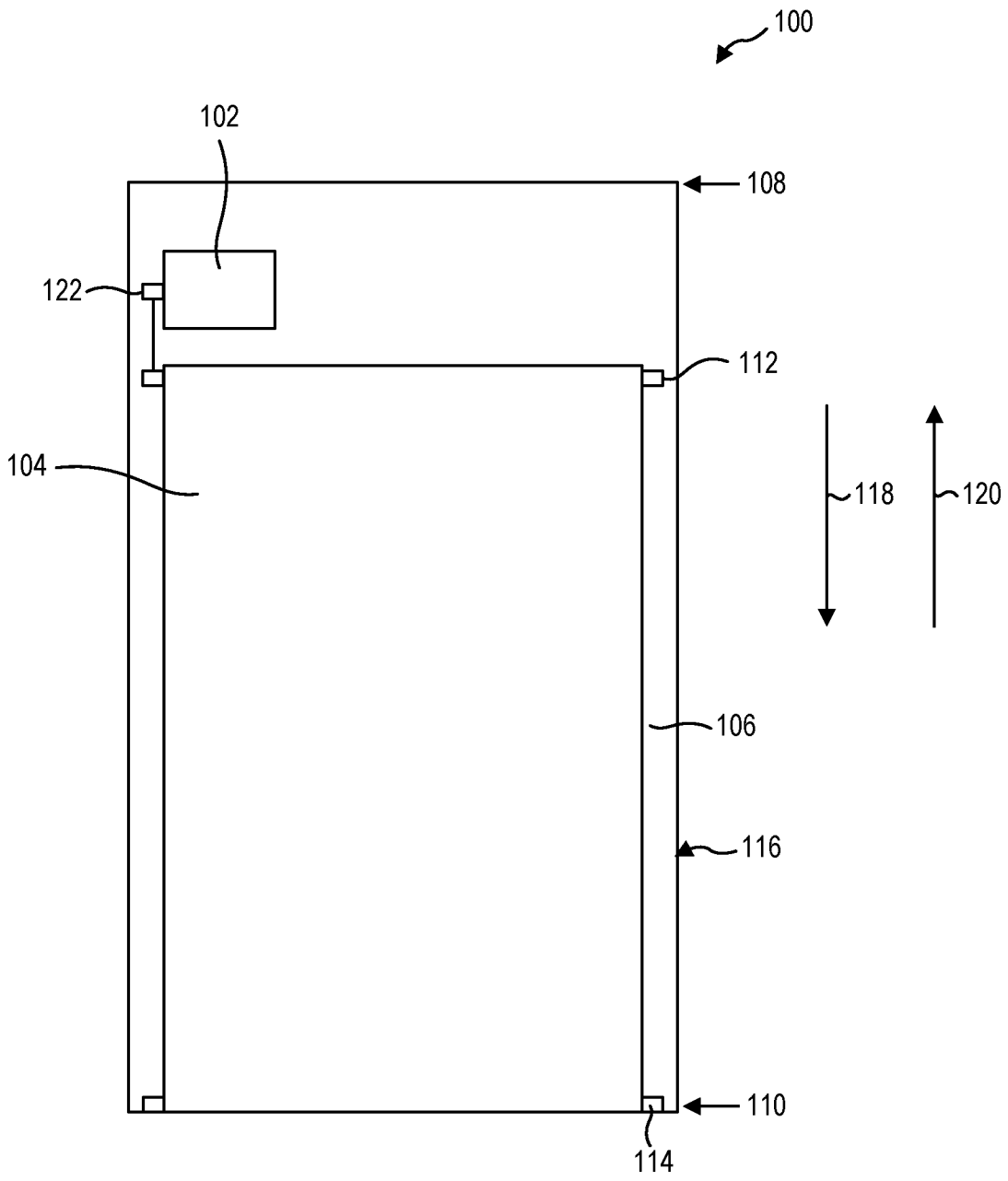
FIG. 1 is a representation of a top-down view of a treadmill having a tread belt rotatable in a forward direction and a backward direction, according to at least one embodiment of the present disclosure.

FIG. 1 is a representation of a treadmill 100 having a motor 102 that rotates a tread belt 104, according to at least one embodiment of the present disclosure. The treadmill 100 includes an exercise deck 106 having a front end 108 and a rear end 110. The tread belt 104 may be an endless belt formed in a loop extending between the front end 108 and the rear end 110. The tread belt 104 is supported at the front end 108 by a front pulley 112 and at the rear end 110 by a rear pulley 114. The exercise deck 106 has a top surface 116, or a working surface, which may be the surface on which the user exercises (e.g., stands, walks, runs, or sprints). In the embodiment shown in FIG. 1, the top surface 116 is the visible surface.

While using the treadmill 100, the user may stand on the top surface 116 of the deck 106 on the tread belt 104. To walk or run, the tread belt 104 may be rotated by the motor 102. The motor 102 may rotate an output shaft 122. The output shaft 122 may be connected to a transfer element, such as a chain or belt, that transfers the rotation of the output shaft 122 to one or both of the front pulley 112 and the rear pulley 114. The motor 102 may cause the front pulley 112 or the rear pulley 114 to rotate, thereby causing the tread belt 104 to rotate. During operation, the tread belt 104 may be rotated in a forward direction 118. While rotating in the forward direction 118, the tread belt 104 may slide from the front end 108 to the rear end 110 over the top surface 116 of the deck 106. Thus, when a user places his or her foot close to the front pulley 112, the rotation of the tread belt 104 may pull the user's foot toward the rear pulley 114. As the user's foot is pulled toward the rear pulley 114, the user may place his or her other foot closer to the front pulley 112 and lift up his or her other foot. This process may be repeated indefinitely.

While the tread belt 104 is rotating in the forward direction 118, the user may face forward (e.g., the user's chest may be oriented toward the front end 108) to walk forwards. This may help the user to be able to interact with the console, view the display, interact with input portions of the display. However, to walk and/or run backwards on the treadmill 100, the user may turn around and face backward. Turning around and walking and/or running backward may be inconvenient and may result in injury to the user. For example, the user may trip while turning around. In another example, the user may not be able to access the controls on the console.

In accordance with embodiments of the present disclosure, the motor 102 may be a bi-directional motor. In some embodiments with a bi-directional motor, the output shaft 122 of the motor 102 may rotate in two directions. As the direction of rotation of the output shaft 122 changes, the direction of rotation of the chain may change. This may change the direction of rotation of the tread belt 104. Thus, when the motor 102 rotates the output shaft 122 in a first direction, the tread belt 104 may be rotated in the forward direction 118. When the motor 102 changes the direction of rotation of the output shaft 122, the tread belt 104 may be rotated in a backward direction 120 (e.g., the tread belt 104 may travel across the top of the deck 106 from the rear pulley 114 to the front pulley 112). In some embodiments, to change the direction of the tread belt 104, the direction of the motor 102 may be reversed.

In accordance with embodiments of the present disclosure, rotating the tread belt 104 in the backward direction 120 may allow the user to walk and/or run backwards (e.g., movement away from the front of the user's chest) while facing the front end 108 of the treadmill 100 (e.g., while the user's chest is facing the front end 108). This may allow the user view of and access to the entirety of the console at the front end 108 of the treadmill 100 while walking and/or running backwards. In this manner a user may access input portions of the console, allowing the user to change the speed of the tread belt 104, the incline of the treadmill 100, access the emergency stop, view information presented on the display (such as heart rate, calorie burn, trainer videos, and so forth), be in line of a fan on a console, access water bottles stored on the console, interact in any other way with the console, and combinations thereof. This may improve the safety of the user by reducing or preventing trips and falls associated with turning around to walk and/or run backwards and returning to walk and/or run forwards and/or reducing or preventing trips and falls associated with attempting to access the console while facing away from it. This may further improve the user experience by smoothing the transition from walking and/or running forwards to walking and/or running backwards.

In some embodiments, the motor 102 may transition from rotating in the forward direction 118 (e.g., rotating the output shaft 122 to rotate the front pulley 112 to rotate the tread belt 104 in the forward direction 118) to rotating in the backward direction 120 during a single exercise activity. In some embodiments, to improve user safety and/or reduce wear and tear on the motor 102, the motor 102 may come to a complete stop and pause for a wait period before rotating in the opposite direction. This may allow the user to slow down and prepare to change directions. This may further help to reduce wear and tear on components of the motor 102 by easing into rotating in different directions.

In some embodiments, one or more safety actions may be taken before the motor transitions between directions. A safety action may include a notification, a prompt for an input, an input, a delay, a ramp-down and ramp-up period, any other safety action, and combinations thereof. In some embodiments, a notification may include a visual notification, such as a light, a flashing light, a message on a display, a light on the tread deck, a light on the console, any other visual notification, and combinations thereof. In some embodiments, a notification may include an audible notification, such as an alarm, a beep, spoken words, any other audible notification, and combinations thereof. In some embodiments, a notification may include a tactile notification, such as haptic feedback in the console, haptics on the deck 106, any other tactile notification, and combinations thereof.

In some embodiments, the safety action may include a positive input. For example, a positive input may include, before the motor 102 changes direction, receiving an input verifying the change in direction. This may improve the safety of the user by preventing the motor 102 from changing directions until the user indicates that he or she is ready. In some embodiments, the input may include pressing a button on the console (e.g., a button push). In some embodiments, the input may include a verbal input, such as a verbal instruction to change directions. In some embodiments, the positive input may include a passcode. For example, the passcode may be input on a keypad or touchscreen of a display. In some embodiments, the passcode may be a numeric passcode, an alphabetic passcode, an alphanumeric passcode, the input of other symbols, and so forth. In some embodiments, the passcode may include answering a safety question. In some embodiments, the input may include any other input.

In some embodiments, the safety action may include an alert and a corresponding response to the alert. For example, the safety action may include two or more parts. The first part may include an alert that asks the user for confirmation of intent to change directions of the tread belt 104. The second part of the safety action may include an input from the user. For example, the input may include a confirmation of intent to change directions of the tread belt 104. In some examples, the first part of the safety action may include an alert that asks the user for confirmation of readiness. After the alert is presented, the second part of the safety action may include the user providing an input indicating his or her readiness for the belt to change directions. After the user provides his or her input, the treadmill 100 may change directions of the tread belt 104. In some embodiments, the treadmill 100 may implement multiple safety actions. For example, the treadmill 100 may implement a first safety action requesting a confirmation of the change in direction of the tread belt 104. After receiving confirmation of the change in direction of the tread belt 104 and before changing directions of the tread belt 104, the treadmill 100 may implement a second safety action requesting an indication of readiness for the treadmill 100 to change directions.

In some embodiments, the safety action may include a delay or a pause between stopping the rotating motor 102 in the first direction and starting rotating the motor 102 in the second direction. In some embodiments, the delay may include 0.25 s, 0.5 s, 0.75 s, 1 s, 1.5 s, 2 s, 3 s, 4 s, 5 s, 6 s, 7 s, 8 s, 9 s, 10 s, or any value therebetween. By including a delay between changing directions on the motor 102, the user may have time to prepare for the transition between directions. In some embodiments, including a delay between changing directions on the motor 102 may help to reduce wear and tear on the motor 102.

In some embodiments a safety action may include a ramp-down and/or ramp-up period. For example, a user may be using the treadmill 100 while the tread belt 104 is rotating in the forward direction 118. During the transition from the forward direction 118 to the backward direction 120, the motor 102 may ramp-down before stopping. For example, the motor 102 may gradually reduce speed before stopping. Gradually reducing speed may help the user transition without an abrupt stop, which may lead to tripping or hurting him or herself. After stopping, the motor 102 may ramp-up speed in the backward direction 120. For example, the motor 102 may gradually increase speed in the backward direction 120. This may help the user transition between directions, thereby reducing or preventing the user from tripping because of a sudden change in speed.

In some embodiments, the treadmill 100 may have a maximum forward speed in the forward direction 118 and a maximum backward speed in the backward direction 120. For example, the motor 102 may be configured to rotate the tread belt 104 in the forward direction 118 with a maximum forward speed. Similarly, the motor 102 may be configured to rotate the tread belt 104 in the backward direction 120 with a maximum backward speed. In some embodiments, the maximum forward speed may be the same as the maximum backward speed.

In some embodiments, the maximum forward speed may be greater than the maximum backward speed. A user may be able to walk and/or run forwards faster than the user may be able to walk and/or run backwards. If the tread belt 104 moves too fast in the backward direction 120, the user may trip and hurt him or herself. A maximum forward speed that is greater than the maximum backward speed may help to prevent the user from falling and thereby injuring him or herself.

Figure 2:
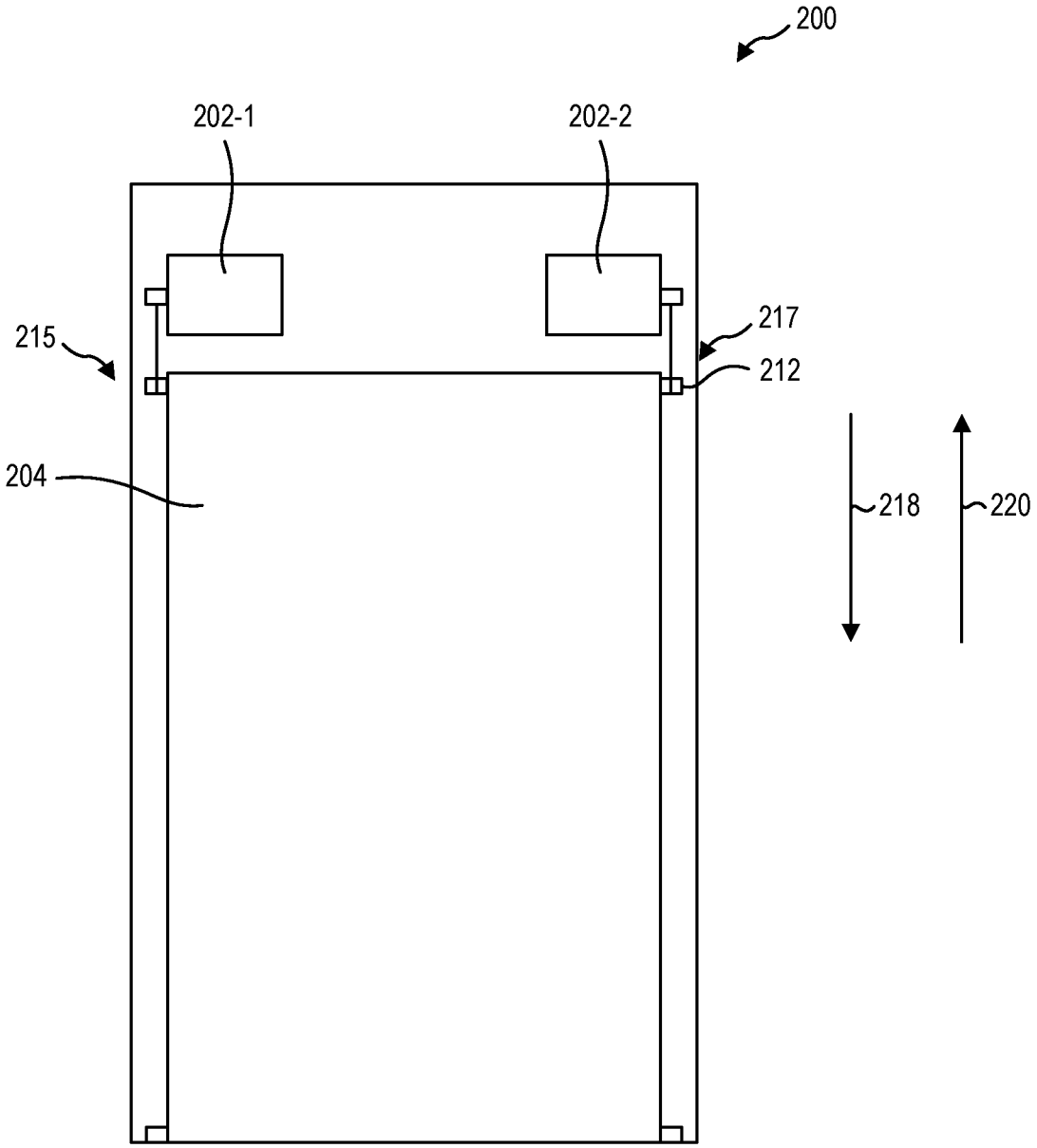
FIG. 2 is a representation of a top-down view of another treadmill having a tread belt rotatable in a forward direction and a backward direction, according to at least one embodiment of the present disclosure.

FIG. 2 is a representation of a treadmill 200 having a tread belt 204 that is rotatable in a forward direction 218 and in a backward direction 220, according to at least one embodiment of the present disclosure. In the embodiment shown, the treadmill 200 includes two motors (collectively 202). A first motor 202-1 may be connected to the front pulley 212 on a first side 215. The first motor 202-1 may be connected such that it only rotates the tread belt 204 in the forward direction 218. A second motor 202-2 may also be connected to the front pulley 212 on a second side 217. The second motor 202-2 may be connected such that it only rotates the tread belt in the backward direction 220.

In accordance with embodiments of the present disclosure, an exercise program to be performed on the treadmill 200 may include at least one forward portion of rotating the tread belt 204 in the forward direction 218 and at least one backward portion of rotating the tread belt 204 in the backward direction 220. In some embodiments, during the forward portion, the tread belt 204 may be rotated by the first motor 202-1. During the forward portion, the second motor 202-2 may be shut off. For example, during the forward portion, the second motor 202-2 may have power disconnected. In some examples, during the forward portion, the second motor 202-2 may not receive any power input.

In some embodiments, during the backward portion, the tread belt 204 may be rotated by the second motor 202-2. During the backward portion, the first motor 202-1 may be shut off. For example, during the backward portion, the first motor 202-1 may have power disconnected. In some examples, during the backward portion, the first motor 202-1 may not receive any power input.

In some embodiments, when transitioning from rotating in the forward direction 218 to the backward direction 220, the treadmill 200 may transition between using the first motor 202-1 and the second motor 202-2. For example, when an exercise program includes a transition from the forward direction 218 to the backward direction 220, the first motor 202-1 may be stopped, and the second motor 202-2 may be started. Similarly, when the exercise program includes a transition from the backward direction 220 to the forward direction 218, the second motor 202-2 may be stopped and the first motor 202-1 may be started.

Including two motors 202 may decrease the load on a single motor 202 that may be caused by changing rotational directions. This may help to reduce wear and tear on the motor 202, thereby increasing the life of the motor 202.

In some embodiments, the first motor 202-1 may have a maximum forward speed in the forward direction 218 and the second motor 202-2 may have a maximum backward speed in the backward direction 220. In some embodiments, the maximum forward speed may be the same as the maximum backward speed. In some embodiments, the maximum forward speed may be greater than the maximum backward speed to help prevent the user from tripping and/or falling while running backwards. In some embodiments, utilizing two different motors 202 may help to control the speed of the tread belt 204.

Figure 3:
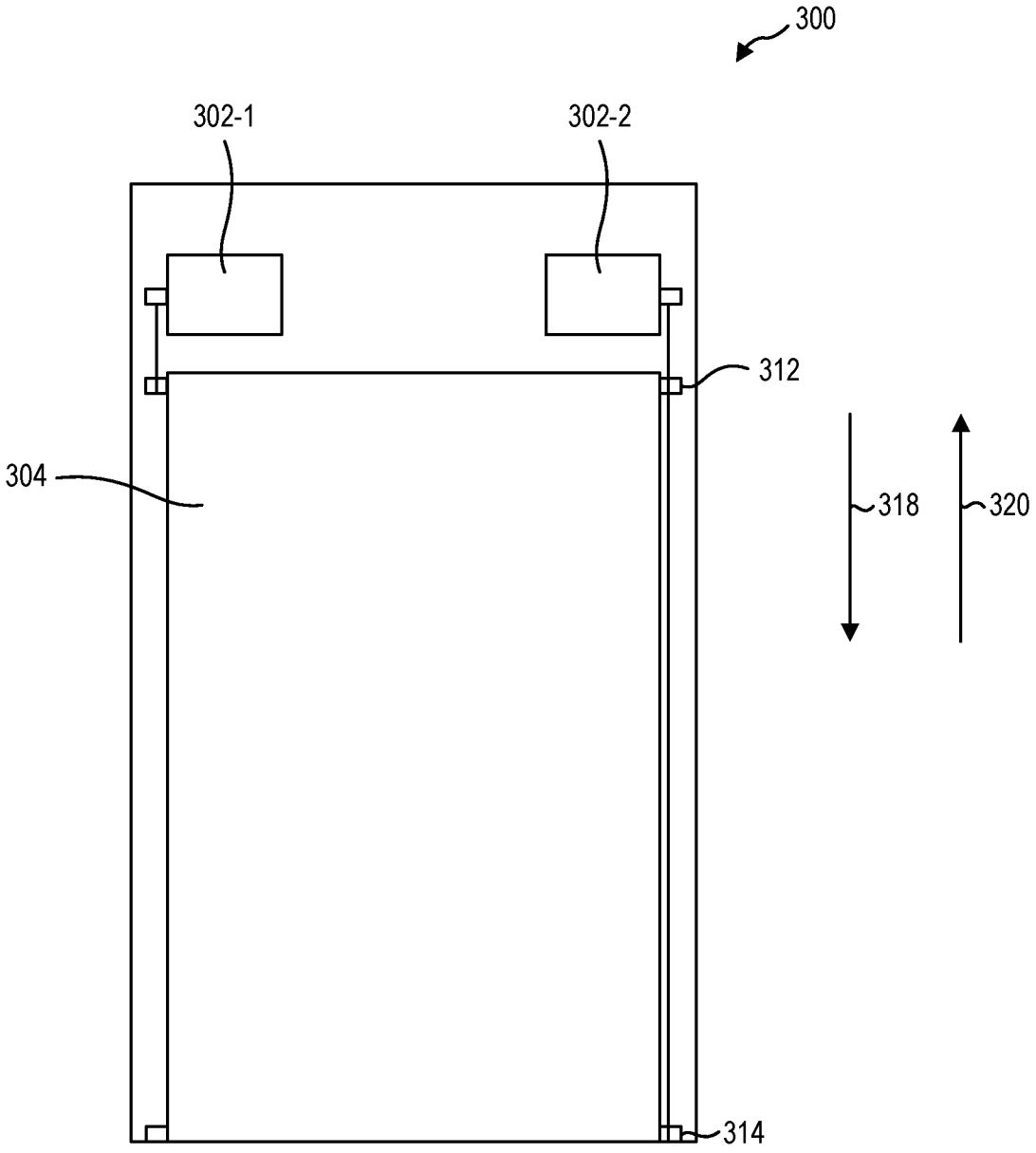
FIG. 3 is a representation of a top-down view of yet another treadmill having a tread belt rotatable in a forward direction and a backward direction, according to at least one embodiment of the present disclosure.

FIG. 3 is a representation of a treadmill 300 having a tread belt 304 that is rotatable in a forward direction 318 and in a backward direction 320, according to at least one embodiment of the present disclosure. In the embodiment shown, the treadmill 300 includes two motors (collectively 302). A first motor 302-1 may be connected to a front pulley 312. The first motor 302-1 may be connected such that it only rotates the tread belt 304 in the forward direction 318. A second motor 302-2 may be connected to a rear pulley 314. The second motor 302-2 may be connected such that it only rotates the tread belt 304 in the backward direction 320. In some embodiments, by connecting the first motor 302-1 to the front pulley 312 and the second motor 302-2 to the rear pulley 314, each motor may connect to a different pulley. In this manner, the torque on the front pulley 312 may be reduced, thereby reducing wear and tear on the front pulley 312.

Figure 4:
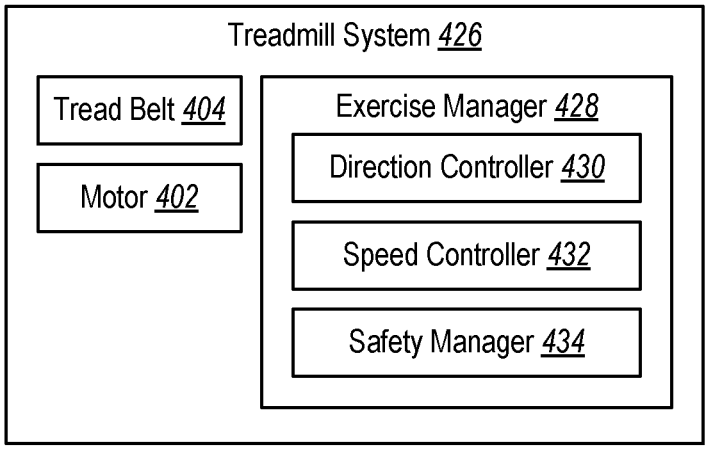
FIG. 4 is a representation of a treadmill system, according to at least one embodiment of the present disclosure.

FIG. 4 is a representation of a treadmill system 426, according to at least one embodiment of the present disclosure. The treadmill system 426 includes an exercise manager 428. The exercise manager 428 may control activation of a motor 402 to rotate a tread belt 404. The exercise manager 428 may include a direction controller 430. The direction controller 430 may control the direction of rotation of the tread belt 404. For example, the direction controller 430 may control the direction of rotation of the motor 402. In some embodiments, where the motor 402 includes a forward motor and a backward motor, the direction controller 430 may control which motor 402 is activated. Put another way, when the exercise manager 428 determines that the tread belt 404 is to rotate in the forward direction, the direction controller 430 may activate the forward motor. When the exercise manager 428 determines that the tread belt 404 is to rotate in the backward direction, the direction controller 430 may activate the backward motor.

The exercise manager 428 may further include a speed controller 432. The speed controller 432 may control the speed of the motor 402. In some embodiments, as discussed herein, the speed controller 432 may control the maximum speed of the tread belt 404. In some embodiments, the speed controller 432 may limit the maximum backward speed to less than the maximum forward speed.

The exercise manager 428 may further include a safety manager 434. In some embodiments, the safety manager 434 may control when the motor 402 is activated in the forward or the backward direction. For example, and as discussed herein with respect to FIG. 1, the safety manager 434 may perform or receive a safety action prior to changing the direction of the tread belt 404. Before performing or receiving the safety action, the safety manager 434 may lock the motor 402, thereby preventing the motor 402 from rotating. After performing or receiving the safety action, the safety manager 434 may unlock the motor 402, thereby allowing the motor 402 to rotate. In some embodiments, the safety manager 434 may receive a positive input from a user. After the safety manager 434 receives the positive input from the user, the safety manager 434 may unlock the motor 402.

Figure 5:
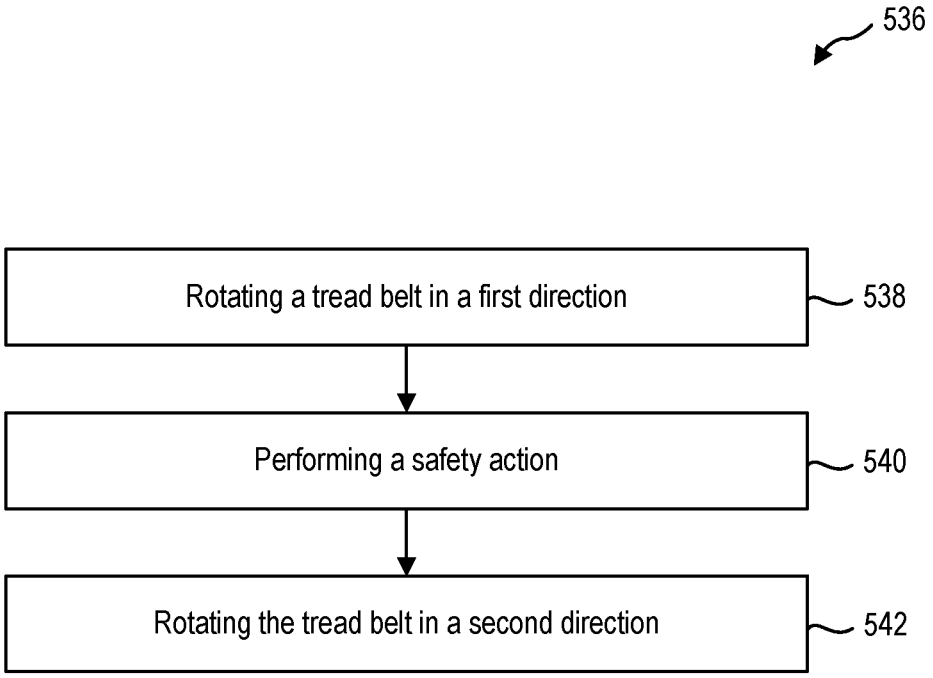
FIG. 5 is a representation of a method for operating a treadmill, according to at least one embodiment of the present disclosure.

FIG. 5 is a representation of a method 536 for operating a treadmill, according to at least one embodiment of the present disclosure. The method 536 may include rotating a tread belt on a treadmill in a first direction at 538. The tread belt may be rotatable in a forward direction and a backward direction so that a user may walk and/or run forwards and backwards while facing the front console. Prior to changing a direction of rotation of the tread belt, the treadmill may perform and/or receive a safety action at 540. In this manner, the treadmill may be prevented from changing directions until the user is ready, thereby improving user safety. After receiving the safety action, the tread belt may be rotated in a second direction at 542. In some embodiments, changing the direction of rotation includes reversing a direction of the motor.

Figure 6:
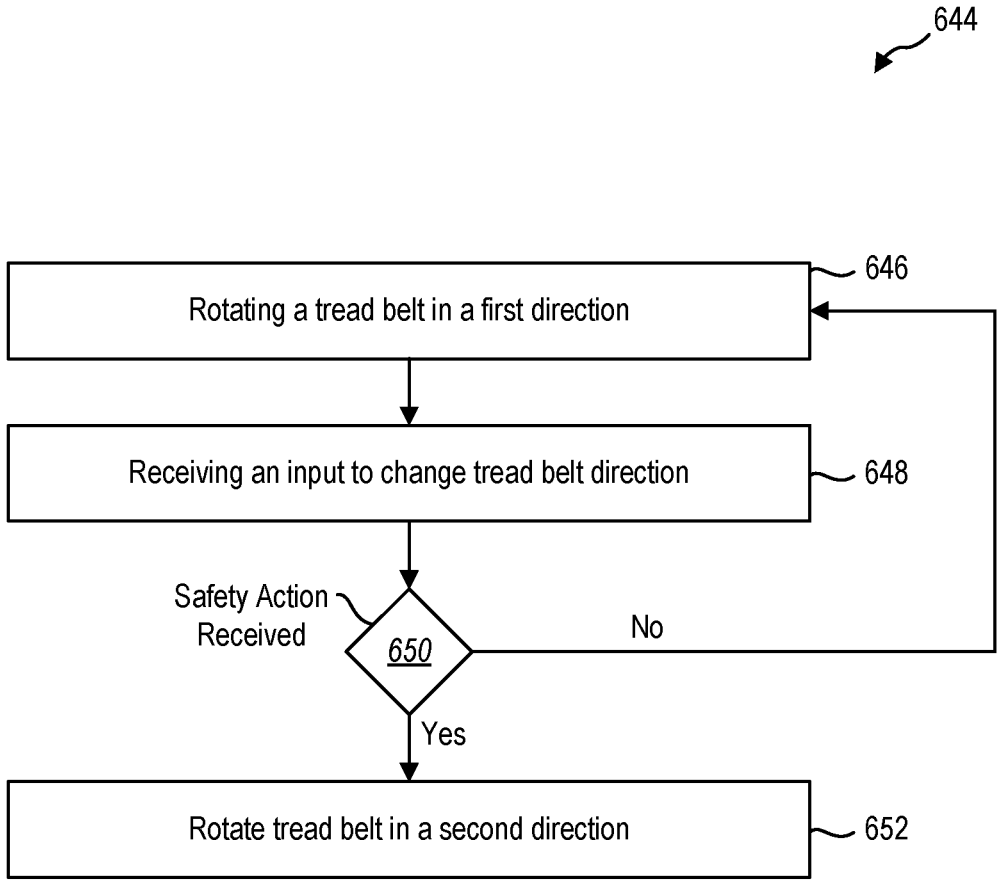
FIG. 6 is a representation of another method for operating a treadmill, according to at least one embodiment of the present disclosure.

FIG. 6 is a representation of a method 644 for operating a treadmill, according to at least one embodiment of the present disclosure. In some embodiments, the method 644 may include rotating a tread belt on a treadmill in a first direction at 646. The tread belt may be rotatable in a forward direction and a backward direction. While the tread belt is rotating in the first direction, the method 644 may include receiving an input to change the rotation direction of the tread belt 648. In some embodiments, the input to change direction may include an input to change direction from forward to backward. In some embodiments, the input to change direction may include an input to change direction from backward to forward.

In some embodiments, the input may be an input from a user on the console. For example, the user may input a command into the console to change the direction of the tread belt. In some embodiments, the input may be an input from an exercise program programmed into the console. For example, an exercise program may include a series of pre-determined exercises, at least two of which may include rotating the tread belt in different directions. When the exercise program reaches the pre-determined exercise that changes the direction of rotation, the exercise program may send an input to change directions.

In some embodiments, the method 644 may include determining whether a safety action has been performed and/or received after the input to change direction has been received at 650. As discussed herein, a safety action may include a notification, a prompt for an input, an input, a delay, a ramp-down and ramp-up period, any other safety action, and combinations thereof. If a safety action has not been received, then the treadmill may continue to rotate the tread belt in the first direction. In some embodiments, if the safety action has not been received, then the treadmill may not rotate the treadmill until the safety action is received.

In some embodiments, if the safety action has been received, the method 644 may include rotating the tread belt in the second direction at 652. Waiting until the safety action has been received to rotate the tread belt in the second direction may help to reduce or prevent injury to the user caused by changing direction when the user is unaware and/or before the user is ready.

Figure 7:
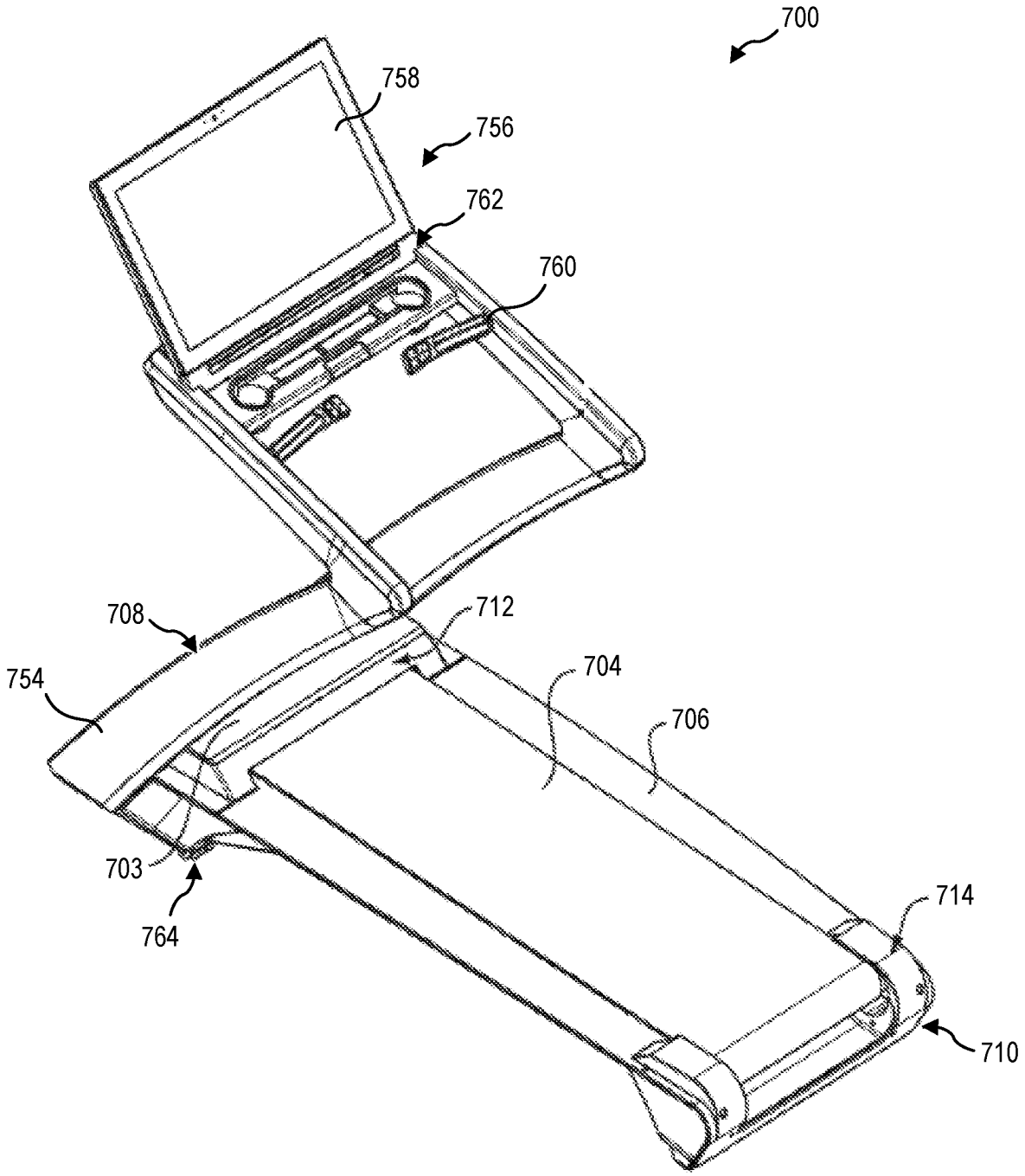
FIG. 7 is a representation of a perspective view of a treadmill having a tread belt rotatable in a forward direction and a backward direction, according to at least one embodiment of the present disclosure.

FIG. 7 is a perspective view of a representation of a treadmill 700, according to at least one embodiment of the present disclosure. The treadmill 700 includes an exercise deck 706. A tread belt 704 is strung or wrapped around the exercise deck 106 from a front pulley 712 to a rear pulley 714. A drive motor located in a housing 703 is connected to the front pulley 712 to rotate the front pulley 712. As the front pulley 712 rotates, the front pulley 712 rotates the tread belt 704 from the front pulley 712 to the rear pulley 714 across the top of exercise deck 706, or from a front end 708 to a rear end 710 of the exercise deck 706.

In some embodiments, the treadmill 700 includes one or more posts 754 that support a console 756. The console 756 may include memory and one or more processors. The memory may include instructions which, when accessed by the processors, cause the processor to implement the methods and systems discussed herein.

The console 756 may include a display 758 and one or more handles 760. In some embodiments, the display 758 may display exercise information, such as biometric information about the user (e.g., heart rate, calorie count). In some embodiments, the display 758 may display training information, such as the incline and speed of the tread belt 704. In some embodiments, training information may include a video or other training program, such as a motivational and/or instructional video of a trainer.

The console 756 may include one or more input portions 762. The input portions 762 may receive input from a user to change one or more exercise parameters (e.g., deck incline, belt speed), receive biometric information (e.g., age, height, weight, heart rate), receive safety actions (e.g., confirmations of direction change), and so forth. In some embodiments, the input portions 762 may include one or more buttons on the console 756. In some embodiments, the input portions 762 may include one or more biometric sensors, such as heart rate sensors. In some embodiments, the display 758 may include the one or more input portions 762 (e.g., the display 758 may be interactive). For example, the display 758 may be a touch-screen display. The user may provide input to the display 758 by interacting with a graphical user interface (GUI) on the touch-screen display. In some embodiments, the user may input any exercise information into the touch-sensitive display 758.

In the embodiment shown, the treadmill 700 includes a lift mechanism 764 at the front end 708 of the exercise deck 706. The lift mechanism 764 is configured to lift the front end 708 of the exercise deck 706, thereby changing an incline of the exercise deck 706. With the front end 708 lifted, the user may walk or run on the treadmill 700 on an incline, or "uphill."

As discussed herein, the tread belt 704 may be rotated in a forward direction (e.g., from the front end 708 to a rear end 710 over the top of the exercise deck 706) and in a backward direction (e.g., from the rear end 710 to the front end 708 over the top of the exercise deck 706). According to embodiments of the present disclosure, a user may provide an input to the console 756 (or an exercise program stored in the memory of the console 756 may include an input) to change the direction of rotation of the tread belt 704.

In some embodiments, the console 756, or other portion of the treadmill 700, may implement a safety action after receiving the input and prior to changing direction of the tread belt 704. As discussed herein, the safety action may include an alert. For example, the alert may be a visual alert displayed on the display 758. In some examples, the alert may be an audible alert played through speakers on the console 756. In some embodiments, the safety action may include receiving an input from the user from the input portion 762. For example, the user may provide confirmation of intent to change direction of the tread belt 704 through an input on the input portion 762. In some examples, the user may indicate readiness to change the direction of the tread belt 704. The safety action may help to improve the safety of the user, thereby reducing the risk of injury caused by changing direction of the tread belt 704.

Figure 8:
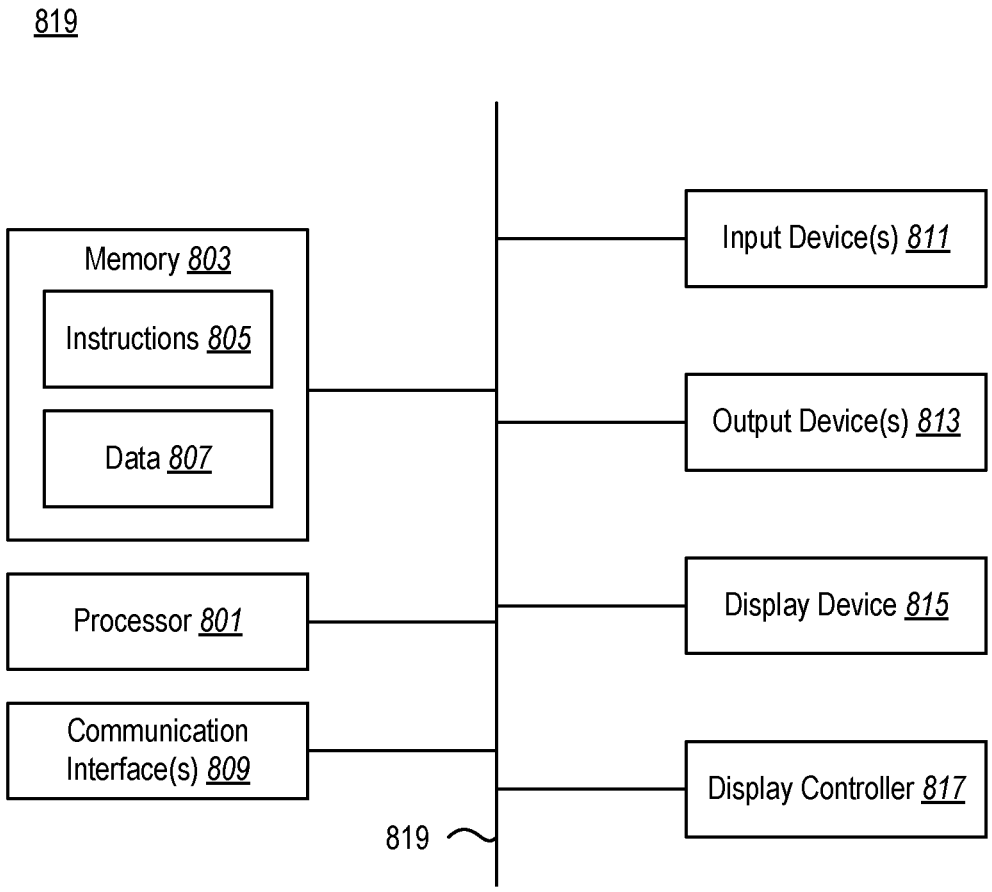
FIG. 8 is a representation of a computing system, according to at least one embodiment of the present disclosure.

FIG. 8 illustrates certain components that may be included within a computer system 819. One or more computer systems 819 may be used to implement the various devices, components, and systems described herein.

The computer system 819 includes a processor 801. The processor 801 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 801 may be referred to as a central processing unit (CPU). Although just a single processor 801 is shown in the computer system 819 of FIG. 8, in an alternative configuration, a combination of processors (e.g., an ARM and DSP) could be used.

The computer system 819 also includes memory 803 in electronic communication with the processor 801. The memory 803 may be any electronic component capable of storing electronic information. For example, the memory 803 may be embodied as random-access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 805 and data 807 may be stored in the memory 803. The instructions 805 may be executable by the processor 801 to implement some or all of the functionality disclosed herein. Executing the instructions 805 may involve the use of the data 807 that is stored in the memory 803. Any of the various examples of modules and components described herein may be implemented, partially or wholly, as instructions 805 stored in memory 803 and executed by the processor 801. Any of the various examples of data described herein may be among the data 807 that is stored in memory 803 and used during execution of the instructions 805 by the processor 801.

A computer system 819 may also include one or more communication interfaces 809 for communicating with other electronic devices. The communication interface(s) 809 may be based on wired communication technology, wireless communication technology, or both. Some examples of communication interfaces 809 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 819 may also include one or more input devices 811 and one or more output devices 813. Some examples of input devices 811 include a keyboard, mouse, microphone, remote control device, button, joystick, trackball, touchpad, and light pen. Some examples of output devices 813 include a speaker and a printer. One specific type of output device that is typically included in a computer system 819 is a display device 815. Display devices 815 used with embodiments disclosed herein may utilize any suitable image projection technology, such as liquid crystal display (LCD), light-emitting diode (LED), gas plasma, electroluminescence, or the like. A display controller 817 may also be provided, for converting data 807 stored in the memory 803 into text, graphics, and/or moving images (as appropriate) shown on the display device 815.

The various components of the computer system 819 may be coupled together by one or more buses, which may include a power bus, a control signal bus, a status signal bus, a data bus, etc. For the sake of clarity, the various buses are illustrated in FIG. 8 as a bus system 819.

INDUSTRIAL APPLICABILITY

This disclosure generally relates to devices, systems, and methods for treadmills with a tread deck that rotates in the forwards and backwards direction. Some exercises may involve a user walking or running in a "backward" direction. A backward direction may be motion, either simulated (such as on a treadmill), or actual (such as on the ground) of the user in the direction opposite he or she is facing. Conventionally, the tread deck of a treadmill may only rotate in the forward direction (e.g., from the front end to the back end over the top of the tread deck). To walk or run backwards on the treadmill, the user may turn around and face away from the console. However, when facing away from the console, the user may not be able to see the display and/or interact with the input elements. This may introduce safety concerns, because the user may not be able to easily activate an emergency stop, change the tread belt speed, view exercise information on the display, other safety concerns, and combinations thereof.

In accordance with embodiments of the present disclosure, a treadmill may be configured to rotate the tread belt in the forward direction and in the backward direction. Rotating the tread belt in the backward direction may include rotating the tread belt from the rear end to the front end over the top of the deck. By rotating the tread belt in the backward direction, the user may face forward on the treadmill (e.g., the console). This may allow the user full access of the features of the console. In this manner, the safety of the user while walking or running backwards may be increased because the user may be able to access the emergency stop, the speed controls, exercise information on the console, and so forth.

In some embodiments, a treadmill has a motor that rotates a tread belt, according to at least one embodiment of the present disclosure. The treadmill includes an exercise deck having a front end and a rear end. The tread belt may be an endless belt formed in a loop extending between the front end and the rear end. The tread belt is supported at the front end by a front pulley and at the rear end by a rear pulley. The exercise deck has a top surface, or a working surface, which may be the surface on which the user exercises (e.g., stands, walks, runs, or sprints). In some embodiments, the top surface is the visible surface.

While using the treadmill, the user may stand on the top surface of the deck on the tread belt. To walk or run, the tread belt may be rotated by the motor. The motor may rotate an output shaft. The output shaft may be connected to a transfer element, such as a chain or belt, that transfers the rotation of the output shaft to one or both of the front pulley and the rear pulley. The motor may cause the front pulley or the rear pulley to rotate, thereby causing the tread belt to rotate. During operation, the tread belt may be rotated in the forward direction. While rotating in the forward direction, the tread belt may slide from the front end to the rear end over the top surface of the deck. Thus, when a user places his or her foot close to the front pulley, the rotation of the tread belt may pull the user's foot toward the rear pulley. As the user's foot is pulled toward the rear pulley, the user may place his or her other foot closer to the front pulley and lift up his or her other foot. This process may be repeated indefinitely.

While the tread belt is rotating in the forward direction, the user may face forward (e.g., the user's chest may be oriented toward the front end) to walk forwards. This may help the user to be able to interact with the console, view the display, interact with input portions of the display. However, to walk and/or run backwards on the treadmill, the user may turn around and face backward. Turning around and walking and/or running backward may be inconvenient and may result in injury to the user. For example, the user may trip while turning around. In another example, the user may not be able to access the controls on the console.

In accordance with embodiments of the present disclosure, the motor may be a bi-directional motor. In some embodiments with a bi-directional motor, the output shaft of the motor may rotate in two directions. As the direction of rotation of the output shaft changes, the direction of rotation of the chain may change. This may change the direction of rotation of the tread belt. Thus, when the motor rotates the output shaft in a first direction, the tread belt may be rotated in the forward direction. When the motor changes the direction of rotation of the output shaft, the tread belt may be rotated in the backward direction (e.g., the tread belt may travel across the top of the deck from the rear pulley to the front pulley). In some embodiments, to change the direction of the tread belt, the direction of the motor may be reversed.

In accordance with embodiments of the present disclosure, rotating the tread belt in the backward direction may allow the user to walk and/or run backwards (e.g., movement away from the front of the user's chest) while facing the front end of the treadmill (e.g., while the user's chest is facing the front end). This may allow the user view of and access to the entirety of the console at the front end of the treadmill while walking and/or running backwards. In this manner a user may access input portions of the console, allowing the user to change the speed of the tread belt, the incline of the treadmill, access the emergency stop, view information presented on the display (such as heart rate, calorie burn, trainer videos, and so forth), be in line of a fan on a console, access water bottles stored on the console, interact in any other way with the console, and combinations thereof. This may improve the safety of the user by reducing or preventing trips and falls associated with turning around to walk and/or run backwards and returning to walk and/or run forwards and/or reducing or preventing trips and falls associated with attempting to access the console while facing away from it. This may further improve the user experience by smoothing the transition from walking and/or running forwards to walking and/or running backwards.

In some embodiments, the motor may transition from rotating in the forward direction (e.g., rotating the output shaft to rotate the front pulley to rotate the tread belt in the forward direction) to rotating in the backward direction during a single exercise activity. In some embodiments, to improve user safety and/or reduce wear and tear on the motor, the motor may come to a complete stop and pause for a wait period before rotating in the opposite direction. This may allow the user to slow down and prepare to change directions. This may further help to reduce wear and tear on components of the motor by easing into rotating in different directions.

In some embodiments, one or more safety actions may be taken before the motor transitions between directions. A safety action may include a notification, a prompt for an input, an input, a delay, a ramp-down and ramp-up period, any other safety action, and combinations thereof. In some embodiments, a notification may include a visual notification, such as a light, a flashing light, a message on a display, a light on the tread deck, a light on the console, any other visual notification, and combinations thereof. In some embodiments, a notification may include an audible notification, such as an alarm, a beep, spoken words, any other audible notification, and combinations thereof. In some embodiments, a notification may include a tactile notification, such as haptic feedback in the console, haptics on the deck, any other tactile notification, and combinations thereof.

In some embodiments, the safety action may include a positive input. For example, a positive input may include, before the motor changes direction, receiving an input verifying the change in direction. This may improve the safety of the user by preventing the motor from changing directions until the user indicates that he or she is ready. In some embodiments, the input may include pressing a button on the console (e.g., a button push). In some embodiments, the input may include a verbal input, such as a verbal instruction to change directions. In some embodiments, the positive input may include a passcode. For example, the passcode may be input on a keypad or touchscreen of a display. In some embodiments, the passcode may be a numeric passcode, an alphabetic passcode, an alphanumeric passcode, the input of other symbols, and so forth. In some embodiments, the passcode may include answering a safety question. In some embodiments, the input may include any other input.

In some embodiments, the safety action may include an alert and a corresponding response to the alert. For example, the safety action may include two or more parts. The first part may include an alert that asks the user for confirmation of intent to change directions of the tread belt. The second part of the safety action may include an input from the user. For example, the input may include a confirmation of intent to change directions of the tread belt. In some examples, the first part of the safety action may include an alert that asks the user for confirmation of readiness. After the alert is presented, the second part of the safety action may include the user providing an input indicating his or her readiness for the belt to change directions. After the user provides his or her input, the treadmill may change directions of the tread belt. In some embodiments, the treadmill may implement multiple safety actions. For example, the treadmill may implement a first safety action requesting a confirmation of the change in direction of the tread belt. After receiving confirmation of the change in direction of the tread belt and before changing directions of the tread belt, the treadmill may implement a second safety action requesting an indication of readiness for the treadmill to change directions.

In some embodiments, the safety action may include a delay or a pause between stopping the rotating motor in the first direction, and starting rotating the motor in the second direction. In some embodiments, the delay may include 0.25 s, 0.5 s, 0.75 s, 1 s, 1.5 s, 2 s, 3 s, 4 s, 5 s, 6 s, 7 s, 8 s, 9 s, 10 s, or any value therebetween. By including a delay between changing directions on the motor, the user may have time to prepare for the transition between directions. In some embodiments, including a delay between changing directions on the motor may help to reduce wear and tear on the motor.

In some embodiments a safety action may include a ramp-down and/or ramp-up period. For example, a user may be using the treadmill while the tread belt is rotating in the forward direction. During the transition from the forward direction to the backward direction, the motor may ramp-down before stopping. For example, the motor may gradually reduce speed before stopping. Gradually reducing speed may help the user transition without an abrupt stop, which may lead to tripping or hurting him or herself. After stopping, the motor may ramp-up speed in the backward direction. For example, the motor may gradually increase speed in the backward direction. This may help the user transition between directions, thereby reducing or preventing the user from tripping because of a sudden change in speed.

In some embodiments, the treadmill may have a maximum forward speed in the forward direction and a maximum backward speed in the backward direction. For example, the motor may be configured to rotate the tread belt in the forward direction with a maximum forward speed. Similarly, the motor may be configured to rotate the tread belt in the backward direction with a maximum backward speed. In some embodiments, the maximum forward speed may be the same as the maximum backward speed.

In some embodiments, the maximum forward speed may be greater than the maximum backward speed. A user may be able to walk and/or run forwards faster than the user may be able to walk and/or run backwards. If the tread belt moves too fast in the backward direction, the user may trip and hurt him or herself. A maximum forward speed that is greater than the maximum backward speed may help to prevent the user from falling and thereby injuring him or herself.

In some embodiments, the treadmill includes two motors. A first motor may be connected to the front pulley on a first side. The first motor may be connected such that it only rotates the tread belt in the forward direction. A second motor may also be connected to the front pulley on a second side. The second motor may be connected such that it only rotates the tread belt in the backward direction.

In accordance with embodiments of the present disclosure, an exercise program to be performed on the treadmill may include at least one forward portion of rotating the tread belt in the forward direction and at least one backward portion of rotating the tread belt in the backward direction. In some embodiments, during the forward portion, the tread belt may be rotated by the first motor. During the forward portion, the second motor may be shut off. For example, during the forward portion, the second motor may have power disconnected. In some examples, during the forward portion, the second motor may not receive any power input.

In some embodiments, during the backward portion, the tread belt may be rotated by the second motor. During the backward portion, the first motor may be shut off. For example, during the backward portion, the first motor may have power disconnected. In some examples, during the backward portion, the first motor may not receive any power input.

In some embodiments, when transitioning from rotating in the forward direction to the backward direction, the treadmill may transition between using the first motor and the second motor. For example, when an exercise program includes a transition from the forward direction to the backward direction, the first motor may be stopped, and the second motor may be started. Similarly, when the exercise program includes a transition from the backward direction to the forward direction, the second motor may be stopped, and the first motor may be started.

Including two motors may decrease the load on a single motor that may be caused by changing rotational directions. This may help to reduce wear and tear on the motor, thereby increasing the life of the motor.

In some embodiments, the first motor may have a maximum forward speed in the forward direction and the second motor may have a maximum backward speed in the backward direction. In some embodiments, the maximum forward speed may be the same as the maximum backward speed. In some embodiments, the maximum forward speed may be greater than the maximum backward speed to help prevent the user from tripping and/or falling while running backwards. In some embodiments, utilizing two different motors may help to control the speed of the tread belt.

In some embodiments, the treadmill includes two motors. A first motor may be connected to the front pulley. The first motor may be connected such that it only rotates the tread belt in the forward direction. A second motor may be connected to a rear pulley. The second motor may be connected such that it only rotates the tread belt in the backward direction. In some embodiments, by connecting the first motor to the front pulley and the second motor to the rear pulley, each motor may connect to a different pulley. In this manner, the torque on the front pulley may be reduced, thereby reducing wear and tear on the front pulley.

In some embodiments, a treadmill system includes an exercise manager. The exercise manager may control activation of a motor to rotate a tread belt. The exercise manager may include a direction controller. The direction controller may control the direction of rotation of the tread belt. For example, the direction controller may control the direction of rotation of the motor. In some embodiments, where the motor includes a forward motor and a backward motor, the direction controller may control which motor is activated. Put another way, when the exercise manager determines that the tread belt is to rotate in the forward direction, the direction controller may activate the forward motor. When the exercise manager determines that the tread belt is to rotate in the backward direction, the direction controller may active the backward motor.

The exercise manager may further include a speed controller. The speed controller may control the speed of the motor. In some embodiments, as discussed herein, the speed controller may control the maximum speed of the tread belt. In some embodiments, the speed controller may limit the maximum backward speed to less than the maximum forward speed.

The exercise manager may further include a safety manager. In some embodiments, the safety manager may control when the motor is activated in the forward or the backward direction. For example, and as discussed herein, the safety manager may perform or receive a safety action prior to changing the direction of the tread belt. Before performing or receiving the safety action, the safety manager may lock the motor, thereby preventing the motor from rotating. After performing or receiving the safety action, the safety manager may unlock the motor, thereby allowing the motor to rotate. In some embodiments, the safety manager may receive a positive input from a user. After the safety manager receives the positive input from the user, the safety manager may unlock the motor.

In some embodiments, a method for operating a treadmill may include rotating a tread belt on a treadmill in a first direction. The tread belt may be rotatable in a forward direction and a backward direction so that a user may walk and/or run forwards and backwards while facing the front console. Prior to changing a direction of rotation of the tread belt, the treadmill may perform and/or receive a safety action. In this manner, the treadmill may be prevented from changing directions until the user is ready, thereby improving user safety. After receiving the safety action, the tread belt may be rotated in a second direction. In some embodiments, changing the direction of rotation includes reversing a direction of the motor.

In some embodiments, a method for operating a treadmill may include rotating a tread belt on a treadmill in a first direction. The tread belt may be rotatable in a forward direction and a backward direction. While the tread belt is rotating in the first direction, the method may include receiving an input to change the rotation direction of the tread belt. In some embodiments, the input to change direction may include an input to change direction from forward to backward. In some embodiments, the input to change direction may include an input to change direction from backward to forward.

In some embodiments, the input may be an input from a user on the console. For example, the user may input a command into the console to change the direction of the tread belt. In some embodiments, the input may be an input from an exercise program programmed into the console. For example, an exercise program may include a series of pre-determined exercises, at least two of which may include rotating the tread belt in different directions. When the exercise program reaches the pre-determined exercise that changes the direction of rotation, the exercise program may send an input to change directions.

In some embodiments, the method may include determining whether a safety action has been performed and/or received after the input to change direction has been received. As discussed herein, a safety action may include a notification, a prompt for an input, an input, a delay, a ramp-down and ramp-up period, any other safety action, and combinations thereof. If a safety action has not been received, then the treadmill may continue to rotate the tread belt in the first direction. In some embodiments, if the safety action has not been received, then the treadmill may not rotate the treadmill until the safety action is received.

In some embodiments, if the safety action has been received, the method may include rotating the tread belt in the second direction. Waiting until the safety action has been received to rotate the tread belt in the second direction may help to reduce or prevent injury to the user caused by changing direction when the user is unaware and/or before the user is ready.

In some embodiments, a treadmill includes an exercise deck. A tread belt is strung or wrapped around the exercise deck from a front pulley to a rear pulley. A drive motor located in a housing is connected to the front pulley to rotate the front pulley. As the front pulley rotates, the front pulley rotates the tread belt from the front pulley to the rear pulley across the top of exercise deck, or from a front end to a rear end of the exercise deck.

In some embodiments, the treadmill includes one or more posts that support a console. The console may include memory and one or more processors. The memory may include instructions which, when accessed by the processors, cause the processor to implement the methods and systems discussed herein.

The console may include a display and one or more handles. In some embodiments, the display may display exercise information, such as biometric information about the user (e.g., heart rate, calorie count). In some embodiments, the display may display training information, such as the incline and speed of the tread belt. In some embodiments, training information may include a video or other training program, such as a motivational and/or instructional video of a trainer.

The console may include one or more input portions. The input portions may receive input from a user to change one or more exercise parameters (e.g., deck incline, belt speed), receive biometric information (e.g., age, height, weight, heart rate), receive safety actions (e.g., confirmations of direction change), and so forth. In some embodiments, the input portions may include one or more buttons on the console. In some embodiments, the input portions may include one or more biometric sensors, such as heart rate sensors. In some embodiments, the display may include the one or more input portions (e.g., the display may be interactive). For example, the display may be a touch-screen display. The user may provide input to the display by interacting with a graphical user interface (GUI) on the touch-screen display. In some embodiments, the user may input any exercise information into the touch-sensitive display.

In the embodiment shown, the treadmill includes a lift mechanism at the front end of the exercise deck. The lift mechanism is configured to lift the front end of the exercise deck, thereby changing an incline of the exercise deck. With the front end lifted, the user may walk or run on the treadmill on an incline, or "uphill."

As discussed herein, the tread belt may be rotated in a forward direction (e.g., from the front end to a rear end over the top of the exercise deck) and in a backward direction (e.g., from the rear end to the front end over the top of the exercise deck). According to embodiments of the present disclosure, a user may provide an input to the console (or an exercise program stored in the memory of the console may include an input) to change the direction of rotation of the tread belt.

In some embodiments, the console or other portion of the treadmill may implement a safety action after receiving the input and prior to changing direction of the tread belt. As discussed herein, the safety action may include an alert. For example, the alert may be a visual alert displayed on the display. In some examples, the alert may be an audible alert played through speakers on the console. In some embodiments, the safety action may include receiving an input from the user from the input portion. For example, the user may provide confirmation of intent to change direction of the tread belt through an input on the input portion. In some examples, the user may indicate readiness to change the direction of the tread belt. The safety action may help to improve the safety of the user, thereby reducing the risk of injury caused by changing direction of the tread belt.

In some embodiments, one or more computer systems may be used to implement the various devices, components, and systems described herein. The computer system includes a processor. The processor may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU). Although just a single processor is described, a combination of processors (e.g., an ARM and DSP) could be used.

The computer system also includes memory in electronic communication with the processor. The memory may be any electronic component capable of storing electronic information. For example, the memory may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions and data may be stored in the memory. The instructions may be executable by the processor to implement some, or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into text, graphics, and/or moving images (as appropriate) shown on the display device.

The various components of the computer system may be coupled together by one or more buses, which may include a power bus, a control signal bus, a status signal bus, a data bus, etc.

Following are sections describing various embodiments of the present disclosure:

A1. A treadmill, comprising:
- a deck having a front end and a rear end;
- a tread belt extending around the deck;
- a first motor configured to rotate the tread belt from the front end to the rear end; and
- a second motor configured to rotate the tread belt from the rear end to the front end.

A2. The treadmill of section A1, wherein the first motor has a first maximum speed, and the second motor has a second maximum speed, and wherein the first maximum speed is greater than the second maximum speed.

A3. The treadmill of section A1 or A2, further comprising:
- a front pulley connected to the front end of the deck, wherein the first motor is connected to the front pulley; and
- a rear pulley connected to the rear end of the deck, wherein the second motor is connected to the rear pulley.

A4. The treadmill any of sections A1-A3, further comprising a front pulley connected to the front end of the deck, wherein the front pulley includes a first side and a second side, and wherein the first motor is connected to the first side and wherein the second motor is connected to the second side.

A5. The treadmill of any of sections A1-A4, wherein the first motor has a first maximum speed and the second motor has a second maximum speed different from the first maximum speed.

A6. The treadmill of section A5, wherein the maximum second speed is less than the first maximum speed.

B1. A method for operating a treadmill, comprising:
- rotating a tread belt around a deck of the treadmill in a first direction;

receiving an input to rotate the tread belt in a second direction, opposite the first direction;

before rotating the tread belt in the second direction, implementing a safety action; and rotating the tread belt around the deck of the treadmill in the second direction.

B2. The method of section B1, wherein the safety action is an audible alert.

B3. The method of section B1 or B2, wherein the safety action is a visual alert.

B4. The method of any of sections B1-B 3, wherein implementing the safety action includes:

providing an alert; and receiving an input in response to the alert.

B5. The method of section B4, wherein the alert is a request for confirmation and the input includes a confirmation.

B6. The method of section B4 or B5, wherein the input includes a verbal input.

B7. The method of any of sections B1-B6, wherein the safety action is a first safety action, and further comprising implementing a second safety action after implementing the first safety action and before rotating the tread belt in the second direction.

B8. The method of any of sections B1-B7, wherein rotating the tread belt in the second direction includes reversing a direction of a motor.

B9. The method of any of sections B1-B8, further comprising, before rotating the tread belt in the second direction, pausing rotation of the tread belt for a delay.

B10. The method of section B9, wherein the delay is greater than one second.

C1. A treadmill, comprising:

a deck having a front end and a rear end;

a tread belt extending around the deck, the tread belt being rotatable in a forward direction from the front end to the rear end, the tread belt being rotatable in a backward direction from the rear end to the front end; and memory and a processor, the memory including instructions which, when accessed by the processor, cause the processor to:

rotate the tread belt in the forward direction;

receive an input to rotate the tread belt in the backward direction;

implement a safety action before rotating the tread belt in the backward direction; and after implementing the safety action, rotate the tread belt in the backward direction.

C2. The treadmill of section C1, further comprising a console at the front end of the deck, and wherein the safety action is implemented on the console.

C3. The treadmill of section C2, wherein the safety action includes an input by a user on the console.

C4. The treadmill of section C2 or C3, wherein the safety action includes an alert and an input in response to the alert.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A treadmill, comprising:

a deck having a front end and a rear end;

a tread belt extending around the deck;

a motor, in a first configuration configured to rotate the tread belt in a forward direction from the front end to the rear end and in a second configuration configured to rotate the tread belt in a backward direction from the rear end to the front end; and an exercise manager operable to control activation of the motor to rotate the tread belt in the forward direction or the backward direction, wherein the exercise manager is configured to lock the motor in response to an input to rotate the tread belt in a different direction and to unlock the motor after a completion of a safety action.

2. The treadmill of claim 1, wherein the motor has a forward maximum speed and a backward maximum speed, and wherein the forward maximum speed is greater than the backward maximum speed.

3. The treadmill of claim 1, further comprising:

a front pulley connected to the front end of the deck, wherein the motor is connected to the front pulley.

4. A method for operating a treadmill, comprising:

rotating, by a motor of the treadmill, a tread belt around a deck of the treadmill in a first direction;

receiving an input to rotate the tread belt in a second direction, opposite the first direction;

locking the motor based at least in part on receiving the input to rotate the tread belt in the second direction;

implementing a safety action based at least in part on locking the motor;

unlocking the motor based at least in part on a completion of the safety action; and rotating the tread belt around the deck of the treadmill in the second direction based at least in part on unlocking the motor and the completion of the safety action.

5. The method of claim 4, wherein the safety action is an audible alert.

6. The method of claim 4, wherein the safety action is a visual alert.

7. The method of claim 4, wherein implementing the safety action comprises:

providing an alert; and receiving a second input in response to the alert.

8. The method of claim 7, wherein the alert is a request for a confirmation and the second input includes the confirmation.

9. The method of claim 7, wherein the input comprises a verbal input.

10. The method of claim 4, wherein the safety action is a first safety action, the method further comprising:

implementing a second safety action after implementing the first safety action and before rotating the tread belt in the second direction.

11. The method of claim 4, wherein rotating the tread belt in the second direction comprises:

reversing a direction of the motor.

12. The method of claim 4, further comprising:

pausing, before rotating the tread belt in the second direction, rotation of the tread belt for a delay.

13. The method of claim 12, wherein the delay is greater than one second.

14. A treadmill, comprising:

a deck having a front end and a rear end;

a tread belt extending around the deck, the tread belt being rotatable, by a motor of the treadmill, in a forward direction from the front end to the rear end, the tread belt being rotatable in a backward direction from the rear end to the front end; and memory and a processor, the memory including instructions which, when accessed by the processor, cause the processor to:

rotate the tread belt in the forward direction;

receive an input to rotate the tread belt in the backward direction;

lock the motor based at least in part on receiving the input to rotate the tread belt in the backward direction;

implement a safety action based at least in part on locking the motor;

unlock the motor based at least in part on a completion of the safety action; and rotate the tread belt in the backward direction based at least in part on unlocking the motor and the completion of the safety action.

15. The treadmill of claim 14, further comprising:

a console at the front end of the deck, wherein the safety action is implemented on the console.

16. The treadmill of claim 15, wherein the safety action comprises a second input by a user on the console.

17. The treadmill of claim 15, wherein the safety action comprises an alert and a second input in response to the alert.

* * * * *